United States Patent [19]

Akerman et al.

[11] Patent Number: 4,665,857

[45] Date of Patent: May 19, 1987

[54] LANDING PAD AND HANGAR STRUCTURE FOR VERTICAL TAKE-OFF AND LANDING AIRCRAFT

[75] Inventors: Moshe Akerman, Ramat Gan; Amnon Saly, Tel Aviv, both of Israel

[73] Assignee: Israel Aircraft Industries, Ltd., Lodi, Israel

[21] Appl. No.: 845,487

[22] Filed: Mar. 28, 1986

Related U.S. Application Data

[63] Continuation of Ser. No. 213,729, Dec. 5, 1980, abandoned.

[30] Foreign Application Priority Data

Dec. 14, 1979 [IL] Israel ..... 58955
Jan. 25, 1980 [IL] Israel ..... 59224

[51] Int. Cl.[4] ..... B63B 35/50
[52] U.S. Cl. ..... 114/261; 244/110 E
[58] Field of Search ..... 244/110 R, 110 E, 114 R, 244/115; 114/288, 261, 262; 52/64, 66, 86, 646, 648

[56] References Cited

U.S. PATENT DOCUMENTS

| | | | |
|---|---|---|---|
| 2,711,707 | 6/1955 | Seitzman | 114/261 |
| 3,291,422 | 12/1966 | Van Valkenburg | 244/114 R |
| 3,766,691 | 10/1973 | Ray | 52/86 |
| 3,815,299 | 6/1974 | Sorensen et al. | 52/66 |
| 4,106,256 | 8/1978 | Cody | 52/646 |

FOREIGN PATENT DOCUMENTS

| | | | |
|---|---|---|---|
| 2279612 | 2/1976 | France | 114/261 |
| 1511696 | 5/1978 | United Kingdom | 114/261 |

*Primary Examiner*—Joseph F. Peters, Jr.
*Assistant Examiner*—Stephen P. Avila
*Attorney, Agent, or Firm*—Browdy and Neimark

[57] ABSTRACT

A helicopter landing pad and hangar structure attachable particularly to the deck of a ship in a manner requiring a minimum of space on the deck during both helicopter landing and storage, and also requiring no penetration of the deck or other substantial modification of the ship structure, comprises an enclosure including a framework, side walls, and a plurality of panels supported at the top of the side walls and slidable horizontally to an inner retracted position closing the enclosure or to an outer extended position opening the enclosure and extending laterally past the side walls. A lifting platform is movable vertically to a lower position within the enclosure or to an upper position horizontally aligned with the plane of the panels. When the lifting platform is in its upper position it, together with some of the panels in their outer extended positions, constitutes an enlarged-area pad spaced substantially above the deck for the helicopter to land or take-off; and when the lifting platform is in its lower position it permits the helicopter parked thereon to be stored within the enclosure with the slidable panels in their inner positions closing the enclosure and providing a smaller-area pad for another helicopter to land if needed.

10 Claims, 15 Drawing Figures

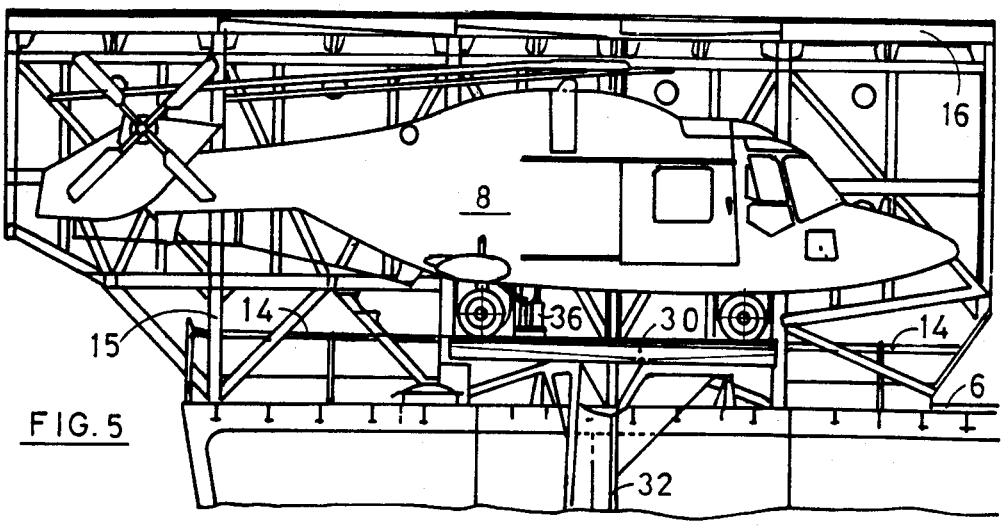
FIG. 5
FIG. 6
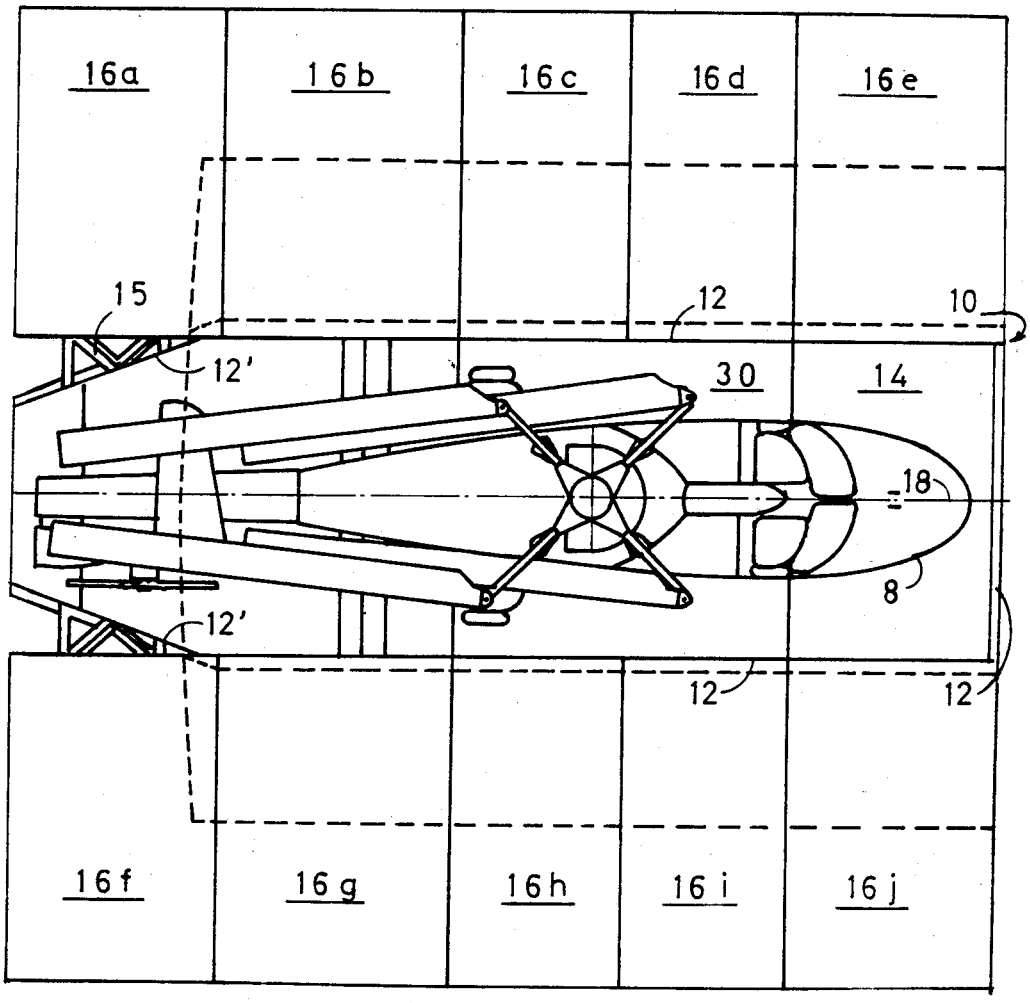

LANDING PAD AND HANGAR STRUCTURE FOR VERTICAL TAKE-OFF AND LANDING AIRCRAFT

This application is a continuation of application Ser. No. 213,729, filed Dec. 5, 1980 now abandoned.

BACKGROUND OF THE INVENTION

The present invention relates to a landing pad and hangar structure for vertical take-off and landing aircraft, particularly helicopters.

A number of landing pad and hangar structures for this purpose have been constructed or proposed, examples of such structures being described in U.S. Pat. Nos. 3,785,316; 3,555,748; 3,248,830; 2,329,941 and 1,777,083. The present invention provides a landing pad and hangar structure having advantages over these known constructions in that it can be attached to the deck of an existing ship, or of off-shore drilling rigs and land-based landing pads, with very little modification of the ship or other structure; it permits the landing, storage and protection of the helicopter in a very limited space; and it can accommodate a second helicopter if necessary.

SUMMARY OF THE PRESENT INVENTION

An object of the present invention is to provide a helicopter landing pad and hangar structure which may be attached to a horizontal deck, particularly to the deck of a ship, in a manner requiring a minimum of space on the deck during both helicopter landing and storage, and also requiring no penetration of the deck or other substantial modification of the ship structure.

According to the invention, the novel helicopter landing pad and hangar structure includes an enclosure attached to the upper face of the deck. This enclosure includes a framework which is attached to the deck, a plurality of side walls attached to the framework and extending above the deck, and a plurality of panels supported by the framework at the top of the side walls above the deck and slidable horizontally to an inner retracted position closing the enclosure, or to an outer extended position opening the enclosure and extending laterally past the side walls. The helicopter landing pad and hangar structure further includes a lifting platform movable vertically either to a lower position (e.g., substantially at deck level) within the enclosure, or to an upper position spaced substantially above the deck and aligned with the plane of the panels. The arrangement is such that when the lifting platform is in its upper position, and at least some of the panels are in their outer extended positions, the lifting platform and the panels together constitute an enlarged-area pad spaced substantially above the deck for the helicopter to land or take off; and when the lifting platform is in its lower position, it permits the helicopter parked thereon to be stored substantially at deck level within the enclosure, with the panels at their inner positions closing the enclosure to protect the parked helicopter and also to provide a smaller-area pad spaced substantially above the deck for another helicopter to land if needed.

It will thus be seen that the novel structure of the present invention is based on the concept of (a) landing the helicopter on a pad located substantially above the deck level, and (b) storing the helicopter at substantially the deck level. This arrangement provides a number of important advantages. Thus, by having the landing pad during landing spaced substantially above the deck level, a minimum of space is required on the deck to accommodate the landing of the helicopter; for example, no deck space need be allocated to accommodate the helicopter rotors during the landing. In addition, by landing the helicopter on a pad disposed substantially above the deck level, and storing the helicopter at substantially deck level, it is not necessary to pierce or penetrate the deck, or to make any other substantial modification in the ship structure.

Further features and advantages of the invention will be apparent from the description below.

BRIEF DESCRIPTION OF THE DRAWINGS

The invention is herein described, by way of example only, with reference to the accompanying drawings, wherein:

FIG. 5 is a side elevation:al view illustrating a helicopter parked in the hangar with the panels in their inboard closed positions as illustrated in FIG. 2;

FIG. 6 is a top plan view illustrating the condition of the structure wherein the panel segments are all in their outboard positions preparatory to raising the parked helicopter to the landing pad for take-off;

DETAILED DESCRIPTION

Figure 1:
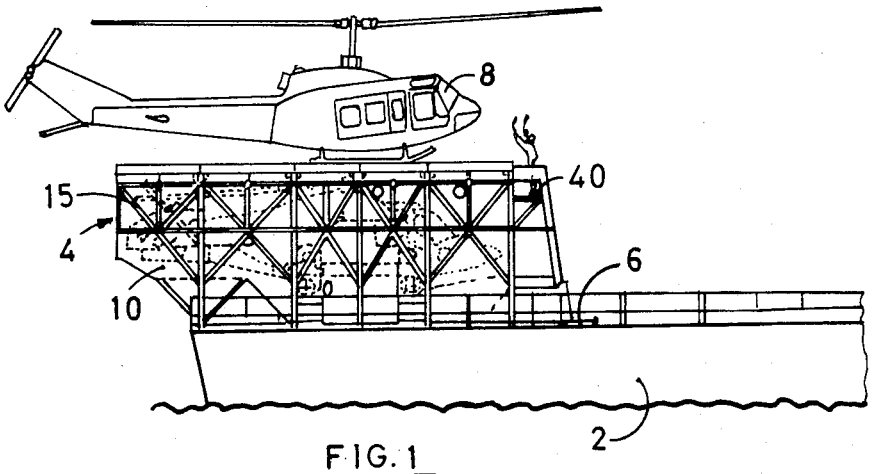
FIG. 1 is a side elevational view illustrating a portion of a ship equipped with one form of shipboard landing pad and hangar structure constructed in accordance with the invention.

With reference first to the embodiment of FIGS. 1–6, FIG. 1 illustrates a ship having a landing pad and hangar structure, generally designated 4, erected on a part of the ship deck 6 (e.g., its stern or aft), which structure is adapted to serve as a landing pad and hangar permitting the landing, take-off and storage of a helicopter, generally designated 8.

Briefly, the landing pad and hangar structure 4 comprises an enclosure 10 defined by side walls 12 and a bottom wall or floor 14 of a configuration to accommodate the helicopter 8 within it after the rotors of the helicopter have been folded, as shown particularly in FIG. 6. The configuration of enclosure 10 is substantially rectangular in horizontal section, as seen in FIG.

6, but has converging side walls 12' at one end accommodating narrower body at the tail of the helicopter. The shape of enclosure 10 can also be seen in broken lines in FIGS. 2 and 3. As shown particularly in FIGS. 4–6, the enclosure 10 is secured to the ship's deck by a framework 15 including vertical columns, horizontal beams, and diagonal bracing, with the floor 14 of the enclosure spaced above the ship's deck 6, and with the walls 12, 12' of the enclosure extending upwardly therefrom.

Figure 2:
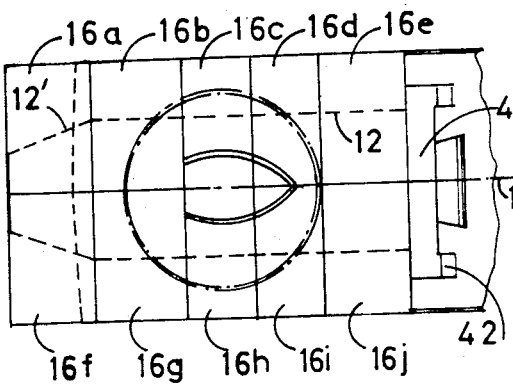
FIG. 2 is a top plan view illustrating the panels in their inboard positions for closing the hangar enclosure.

Enclosure 10 is closable at its top by a plurality of panels, generally designated 16, slidable horizontally to an inner inboard position as shown in FIG. 2 closing the enclosure, or to an outer extended or outboard position opening the enclosure as shown in FIG. 6. In the embodiment of FIGS. 1–6, there are ten of such panels 16 arranged in two rows on opposite sides of the longitudinal axis 18 of the enclosure. Thus, five panels 16*a*–16*e* are disposed on one side of axis 18, and another five panels 16*f*–16*j* are disposed on the opposite side of the axis. The five panels in each row are slidable towards or away from the longitudinal axis 18. When all ten panels 16 are in their inboard positions, as illustrated in FIG. 2, they define a flat flush surface closing enclosure 10 and having an area equal to the sum of the surface areas of all ten panels 16*a*–16*j*; and when they are all in their outboard positions, they fully open enclosure 10.

Each of the panels 16 is slidable on rails 20 (FIG. 4) fixed to the upper part of the framework 15. In the FIGS. 1–6 embodiment, each panel is driven by a hydraulic jack, generally designated 22, having a cylinder 24 pivotably mounted at its inner end to the framework 15, and a piston 26 pivotably mounted to the outboard end of its respective panel 16, Thus, when piston 26 is driven outwardly with respect to its cylinder 24, this causes its respective panel 16 to move in the outboard direction; and when the piston is driven inwardly of its cylinder, this causes the panel to move in the inboard direction.

The enclosure floor 14 is formed with an opening for receiving a lifting platform 30 driven by a hydraulic elevator including a tube 32 to an upper position horizontally aligned with the plane of the panels 16, or to a lower position flush with the enclosure floor 14. Lifting platform 30 is vertically aligned with the intermediate panels 16*c*–16*d* and 16*h*–16*i* so that the lifting platform can assume its upper position only when these intermediate panels are in their outboard positions.

Figure 3:
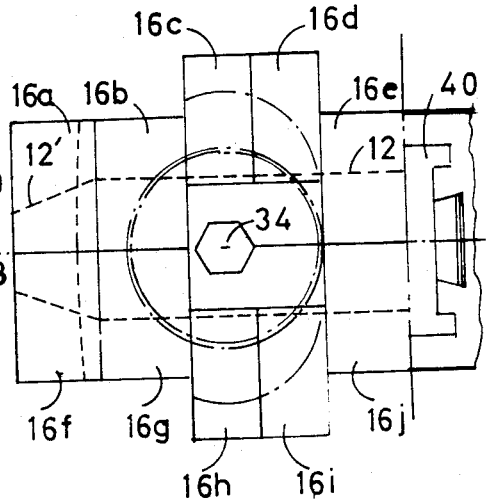
FIG. 3 is a top plan view of the panels of FIG. 2, but showing their positions, and also the position of the lifting platform, during take-off or landing of the helicopter.
Figure 4:
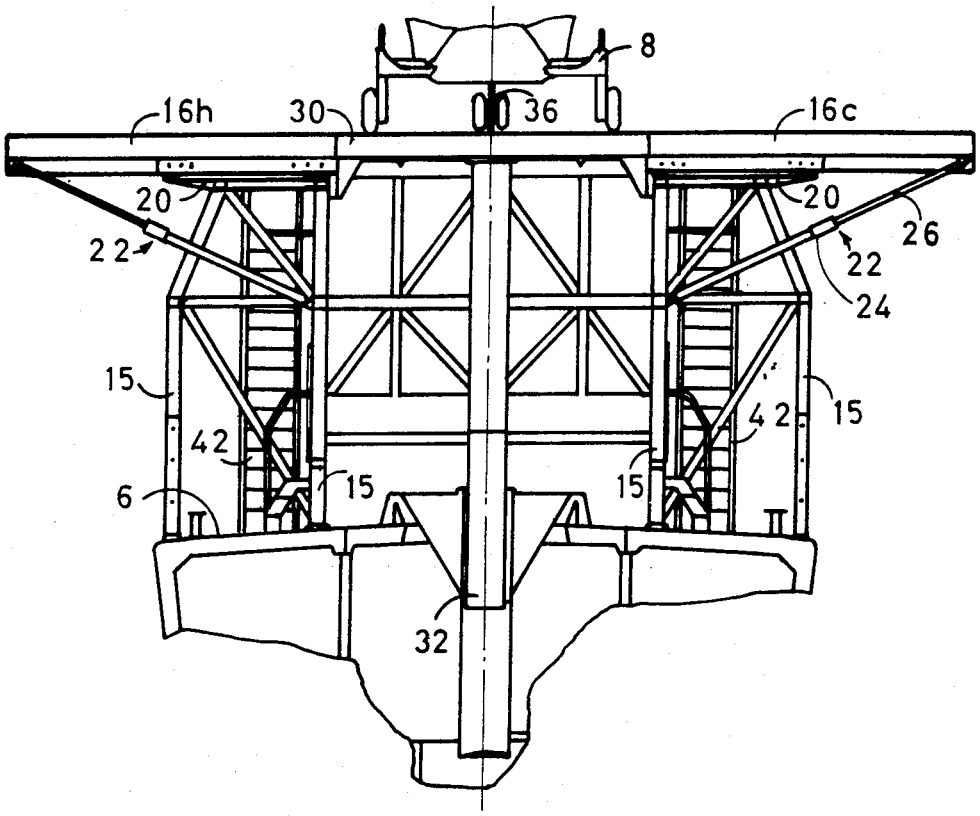
FIG. 4 is an end elevational view of the structure of FIGS. 1–3, illustrating its condition at the time of take-off or landing of the helicopter.

FIG. 3 illustrates the condition of the structure for landing or take-off of the helicopter. In this condition, the lifting platform 30 is in its upper position above the ship deck 6 and horizontally aligned (as shown in FIG. 4) with all the panels 16; the end panels 16*a*, 16*b* and 16*f*, 16*g* at one end of the structure are in their full inboard positions; the end panels 16*e* and 16*j* at the opposite end are also in their full inboard positions; but the intermediate panels 16*c*, 16*d* and 16*h*, 16*i* are in their outboard positions, thereby providing space for accommodating the lifting platform 30. Thus, the lifting platform 30 is flush with, and contiguous on all its sides to, all the panels 16 so that it and the panels form a flat pad of relatively large area for the helicopter to land or take off.

The lifting platform 30 may include an anchoring screen 34 (FIG. 3) engageable by an anchoring leg 36 (FIG. 4) or harpoon commonly applied to the helicopters for anchoring same to the lifting platform.

The landing pad and hangar structure further includes a signalling platform 40 at one end of the enclosure 10 for accommodating the signalman who signals-in the helicopter for a landing. This platform is depressed slightly below the horizontal plane of the panels 16, but elevated above the ship deck 6, it being accessible from the deck by means of a ladder 42 on opposite sides of the platform.

The enclosure 10 including its side walls 12 and floor 14 is made water-tight, and the panels 16, when in their inboard positions as illustrated in FIG. 2, are made splash-proof, both as known in conventional shipboard structures.

The landing pad and hangar structure illustrated in the drawings is used in the following manner:

When the structure is to be used as a pad for landing a helicopter, the intermediate panels 16*c*, 16*d* and 16*h*, 16*i* are moved outwardly to their extended outboard positions, and the lifting platform 30 is moved to its upper position horizontally aligned with the panels 16, at which time the intermediate panels are moved slightly inwardly into abutting contact with the lifting platform 30, as illustrated in FIG. 3. In this position, all the panels 16 join with the lifting platform 30 to provide an enlarged-area pad for the helicopter to land. Once the helicopter lands, its anchoring leg 36 is attached to the anchoring screen 34 on the lifting platform 30, and its rotors may then be folded. All the panels are then moved to their full outboard positions (FIG. 6), and the lifting platform 30 may then be lowered, with the helicopter, into the enclosure 10 to its lowermost position, i.e., flush with the enclosure floor 14, as shown in FIG. 5. All the panels 16 are then slid by their respective hydraulic jacks 22 to their full inboard positions as shown in FIGS. 2 and 5, thereby closing the enclosure 10 and protecting the parked helicopter 8 on platform 30.

Whenever the helicopter 8 stored within enclosure 10 is to be operated, all the panels 16*a*–16*j* are moved by their respective hydraulic jacks 22 to their outboard positions (FIG. 6), thereby fully opening the upper end of enclosure 10. Lifting platform 30 carrying the helicopter 8 is then raised to the level of the panels, whereupon the outer panels 16*a*, 16*b*, 16*e* and 16*f*, 16*j* are moved to their inboard positions and the remaining intermediate panels are moved slightly inwardly, all as described above and as illustrated in FIG. 3, thereby providing an enlarged-area take-off pad for the helicopter.

It will thus be seen that the structure illustrated in FIGS. 1–6 provides a helicopter landing pad and hangar which is conveniently attachable to the deck of an existing ship, requiring little space on the ship deck and relatively little modification of the ship structure. It will also be seen that, if needed, the panels 16, in their inboard positions, can serve as a second landing pad, although of smaller area than the first, for a second helicopter while the first helicopter is stored within the enclosure 10. A further advantages in the illustrated construction is that it permits the helicopter rotors to be folded after the helicopter has been partially lowered within the enclosure, thereby making the rotors more conveniently accessible to the ship personnel.

Figure 7:
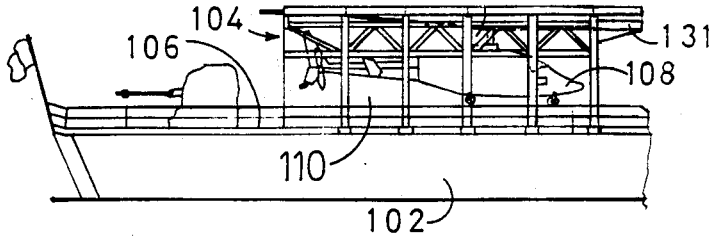
FIG. 7 illustrates another embodiment of the invention.
Figure 8:
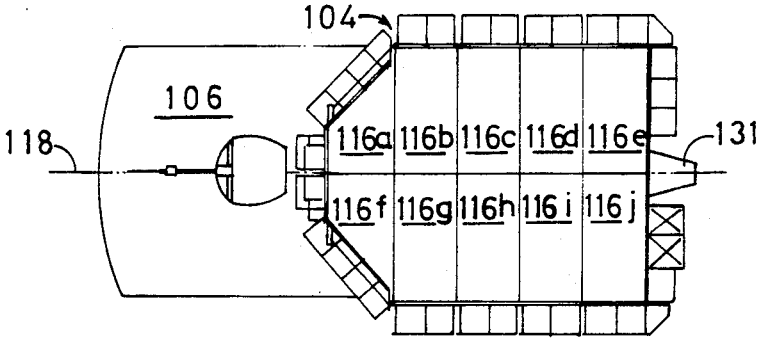
FIGS. 8 and 9 are top plan views of FIG. 7 respectively illustrating the panels in their inboard closed positions, and in their outboard open positions during take-off or landing of the helicopter.
Figure 9:
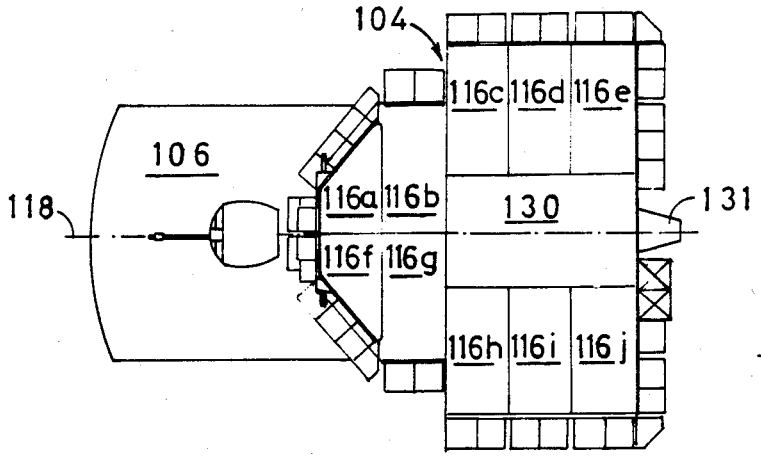

FIGS. 7–9 illustrate another arrangement, including ten panels, designated 116*a*–116*j*, slidable horizontally to an inner inboard position as shown in FIG. 8 closing the enclosure 110, or to an outer outboard position opening the enclosure as shown in FIG. 9. The ten panels are arranged in two rows on opposite sides of the longitudinal axis 118, there being five panels 116*a*–116*e* on one side of axis 118, and another five panels 116*f*–116*j* on the opposite side of the axis. As described in the embodiment of FIGS. 1–6, all the panels of the two rows are slidable, on rails 120 (FIG. 10) to outboard positions in order to fully open enclosure 110, or to inboard positions (FIG. 8) to close the enclosure, and may include a similar drive for each, namely a hydraulic jack 122 having a cylinder 124 pivotably mounted at its inner end to the framework 115, and a piston 126 pivotably mounted to the outboard and of the respective panel.

As distinguished from the arrangement in FIGS. 1–6, however, the panels 116*a*, 116*f* at one end of the landing pad structure are not of rectangular shape but include outer converging walls, in order to accommodate the narrower tail-end of the helicopter. In addition, these two end panels 116*a*, 116*f*, and the two adjacent panels 116*b*, 116*g*, are moved to their inboard positions during the take-off and landing of the helicopter, as illustrated in FIG. 9, whereas the other panels are moved to their outboard positions, with the landing platform 130 in its upper position horizontally aligned with all the above panels, during the landing or take-off of the helicopter.

When the illustrated landing pad and hangar structure is to be used with a non-foldable-wing type helicopter, it is desirable to provide a small fixed cover 131 just underlying and projecting from the end panels 116*e*, 116*j*, to accommodate the tip of the helicopter wing, as shown particularly in FIGS. 7–9.

Figure 10:
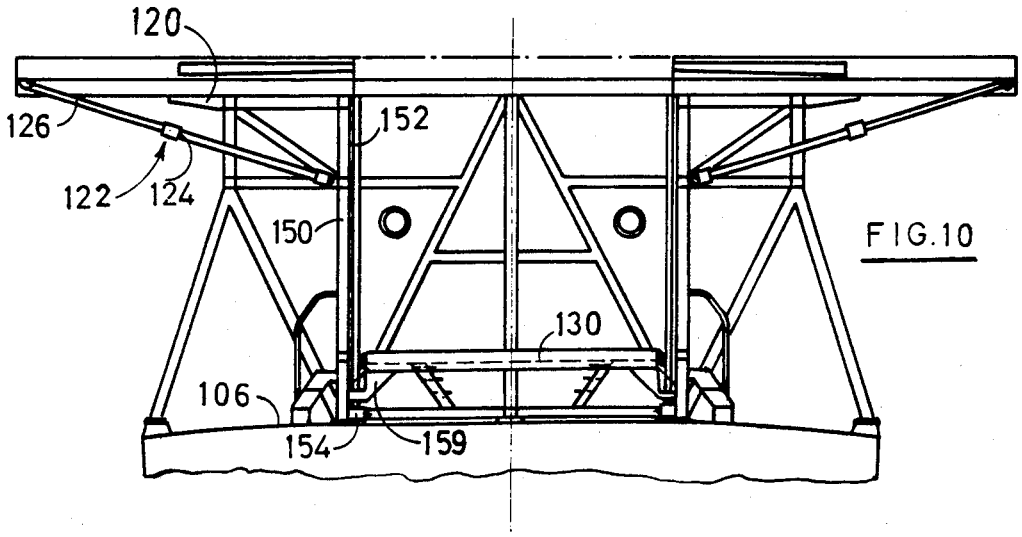
FIG. 10 is a view corresponding to that of FIG. 4 but illustrating another lifting arrangement for the platform.
Figure 11:
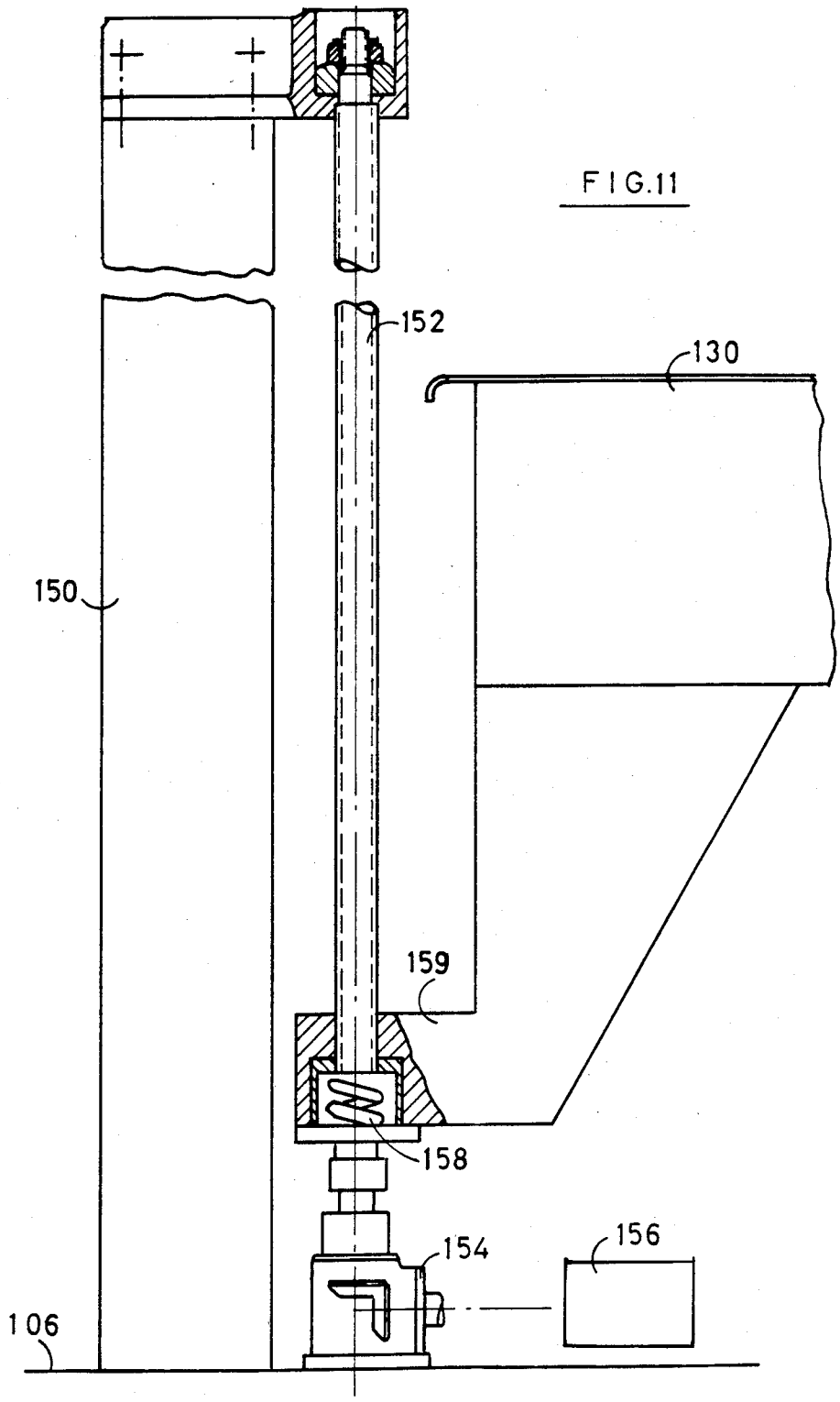
FIG. 11 is an enlarged fragmentary view illustrating the power-driven means coupled to each of the corners of the platform of FIG. 10.

Instead of using a hydraulically-driven tube centrally of the lifting platform 130 for raising and lowering as in FIGS. 1–6, there may be used, as illustrated in FIGS. 10 and 11, an alternative arrangement including a screw-and-nut drive coupled to each of the four corners of the lifting platform 130. Thus, as shown in FIG. 11, at each corner of the lifting platform 130 there is provided a vertical column 150 rotatably mounting a vertical screw 152 coupled by a gear box 154 to a drive, schematically shown at 156. Vertical screw 152 drives a nut 158 on which is floatingly mounted the respective corner 159 of the platform 130. Thus, by operating drive 156, the vertical screws 152 at the four corners of the platform 130 are driven to raise or lower the platform, according to the rotation direction of the drive, The drive 156 may be hydraulic, pneumatic or electric, according to the requirements of the particular application. Also, instead of using a screw-and-nut drive at the four corners, other drives could be used, for example, wire or chain drives. This arrangement, of providing the drives at the four corners of the platform rather than at the center as in FIGS. 1–6, obviates the need to pierce the deck of the ship, and thereby further minimizes the modifications required in the ship structure in order to accommodate the landing pad and hangar.

FIGS. 12–15 illustrate a still further embodiment of the invention including features common to the embodiments of FIGS. 1–6 and FIGS. 7–11, respectively, but also including further improved features. This embodiment is also illustrated as being erected on a ship's deck, generally designated 206, to serve as a landing pad and hangar for a helicopter 208.

The embodiment of FIGS. 12–15 includes an enclosure, generally designated 210, defined by a plurality of side walls 212, and a floor 214 of a configuration to enclose the helicopter 208. Enclosure 210 further includes a plurality of panels 216 slidable horizontally to an inboard position as shown in full lines in FIG. 13, or to an outboard position as shown in broken lines in FIG. 13. The outer ends of the panels are provided with a safety netting 217 adapted to be extended to an almost horizontal position during helicopter takeoff or landing, or to be folded to a substantially vertical position at all other times for safety purposes.

Enclosure 210 is secured to the ship deck 206 with a minimum of modifications to the normal structure of the ship deck, by a framework, generally designated 215, including vertical columns, horizontal beams, and diagonal bracing wherever required, similar to the arrangement described above with respect to FIGS. 1–6.

The slidable panels 216 of enclosure 210 are disposed in an arrangement similar to that illustrated in FIGS. 1–6, namely in two rows each of five panels on opposite sides of the longitudinal axis of the enclosure. The method of slidably mounting each of these panels 216, and the drive for moving them, however, are different from the arrangement of FIGS. 1–6.

Figure 14:
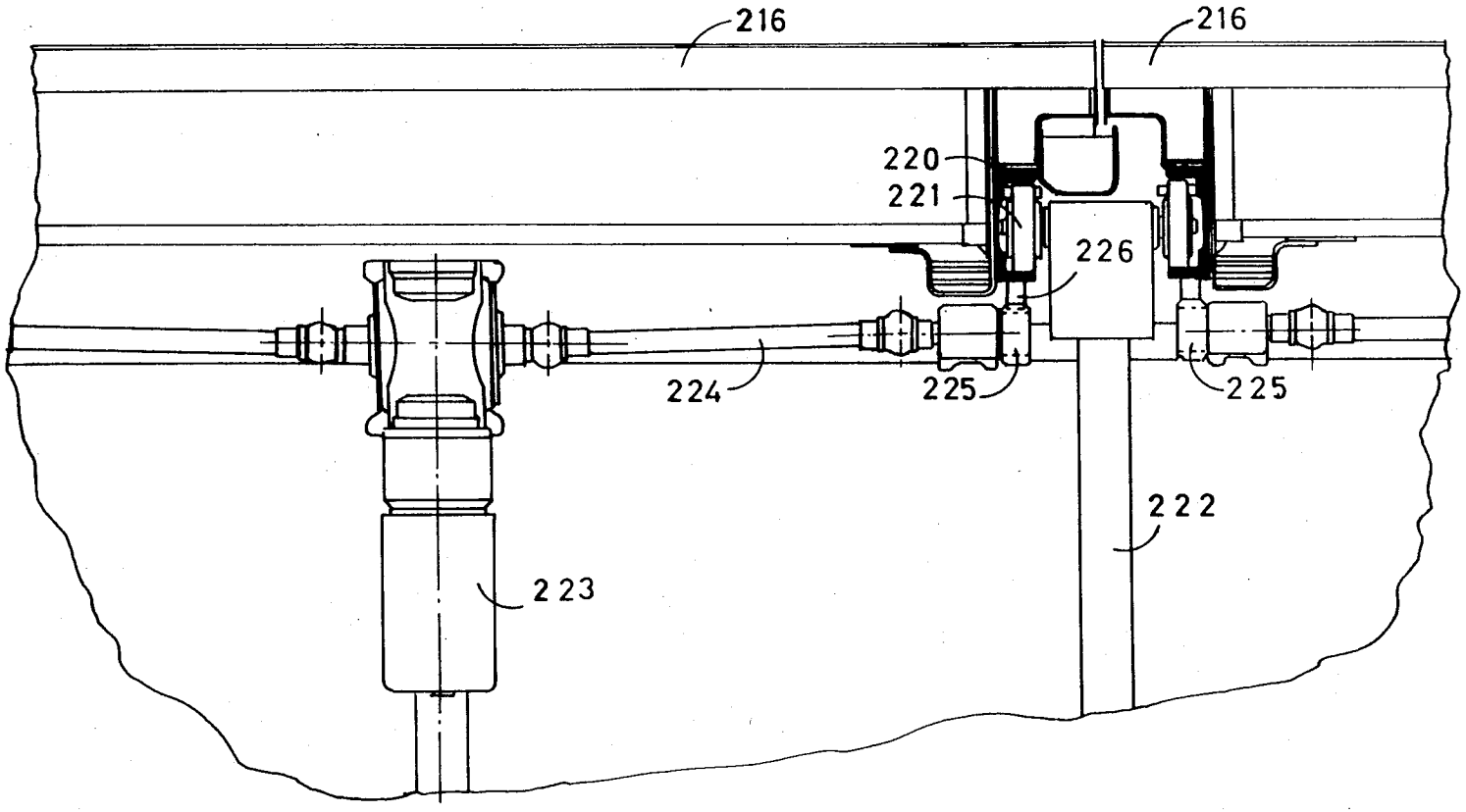
FIGS. 14 and 15 are enlarged fragmentary views illustrating features of construction in the embodiment of FIGS. 12 and 13.

Thus, as shown particularly in FIG. 14, each of the slidable panels 216 is provided along its opposite sides with a channel member 220 serving as a rail for receiving a roller or wheel 221 carried by fixed vertical columns 222 of the frame structure 215 of the enclosure. A vertical column 222 is provided between each pair of slidable panels 216, and also at the outer ends of the end panels so as to firmly support the panels while permitting them to be slid by the rotation of the rollers 221 within the rails 220.

Figure 12:
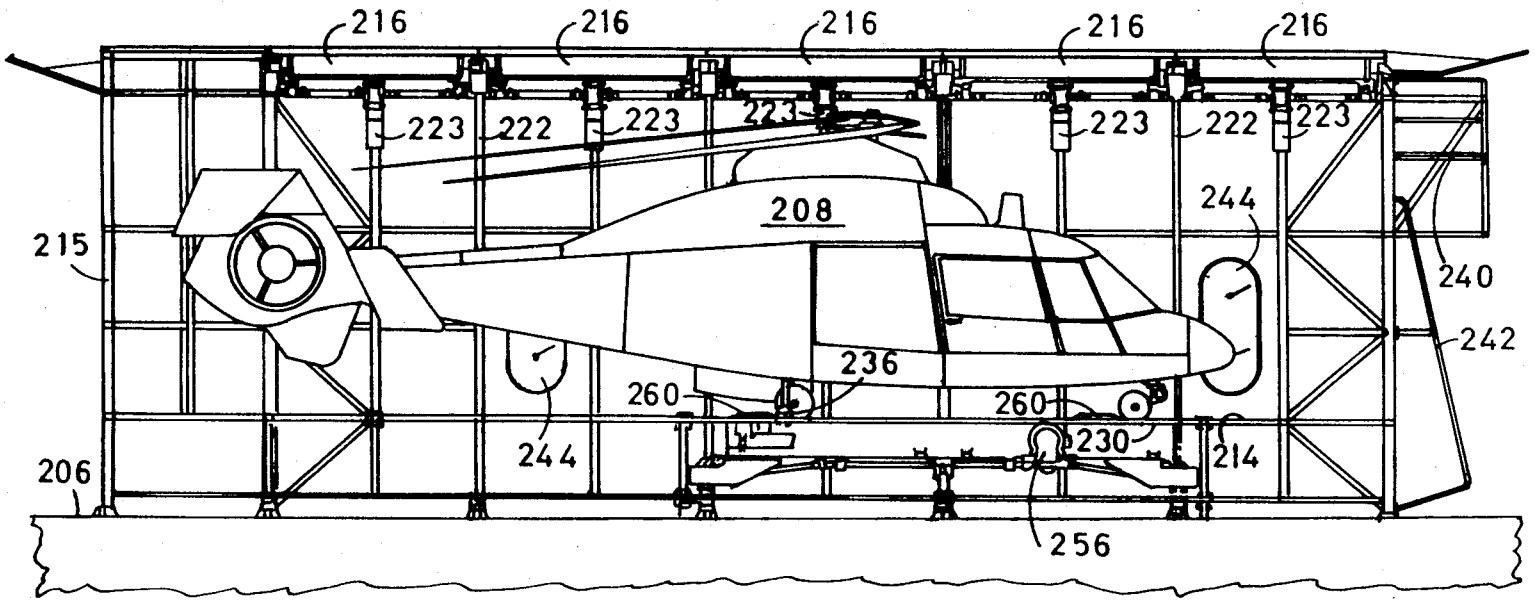
FIG. 12 is a side elevational view illustrating a still further embodiment of the invention.
Figure 13:
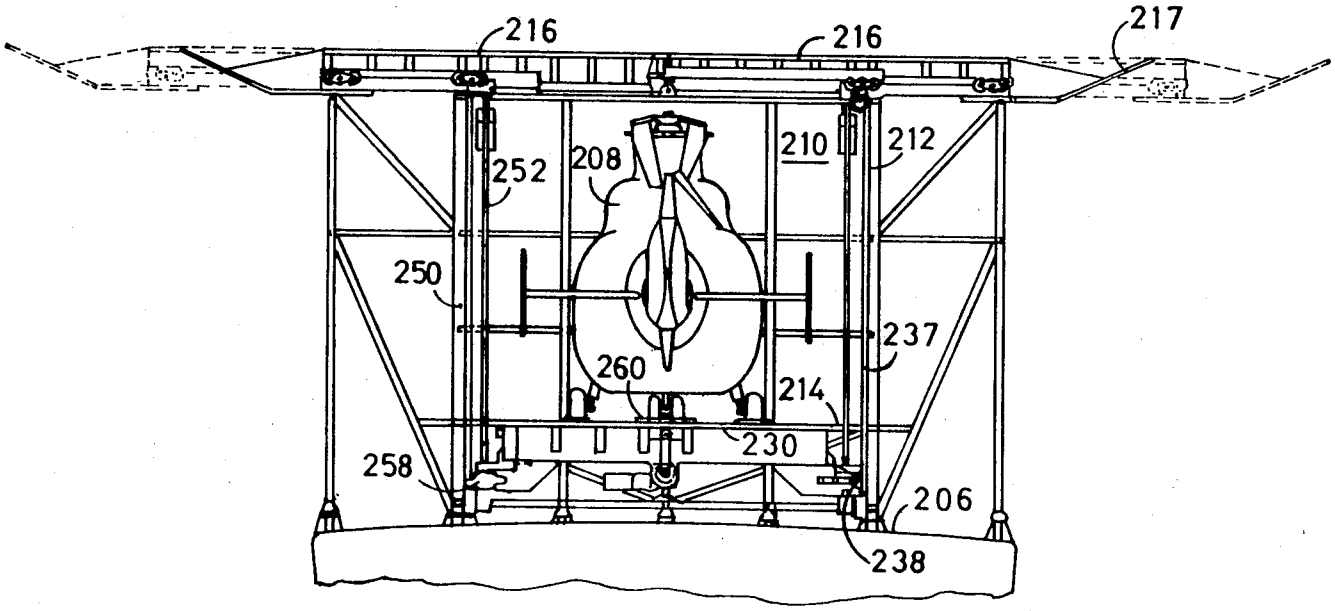
FIG. 13 is a front elevational view of FIG. 12.

The panels 216 are driven to their inboard and outboard positions by a drive 223 including a transmission, generally designated 224, driving a pinion 225 provided for each end of each panel 216 and meshing with a rack 226 secured to each rail 220 of the panels. As shown in FIG. 12, there is a separate drive 223 for the two pinions 225 for each panel 216 so that each panel may be selectively driven either to its inboard position or to its outboard position.

As in the arrangement illustrated in FIGS. 1–6, the enclosure floor 214 is formed with an opening for receiving the lifting platform 230 which platform, in its elevated position, constitutes part of the landing and take-off pad for the helicopter, and in its lowered position supports the helicopter within the enclosure 210. The drive for the lifting platform 230 is similar to that illustrated in FIGS. 10 and 11, in that it includes a lifting device coupled to each corner of the platform 230 in order to avoid the need for piercing the ship deck 206. Thus, the framework structure 215 includes a plurality of vertical columns 250, (e.g., FIG. 13), one at each corner of the lifting platform 230 and several intermediate ones. The vertical column at each corner mounts a vertical screw 252 received within a nut 258 rotatably mounted to each of the corners of the lifting platform 230. Each nut is rotated by a shaft 259 (FIG. 15) coupled to the elevator drive 256 (FIG. 12), so that when the nuts 252 are rotated by drive 256 in one direction, the lifting platform 230 is elevated, and when the nuts are rotated in the opposite direction, the lifting platform is lowered.

Figure 15:
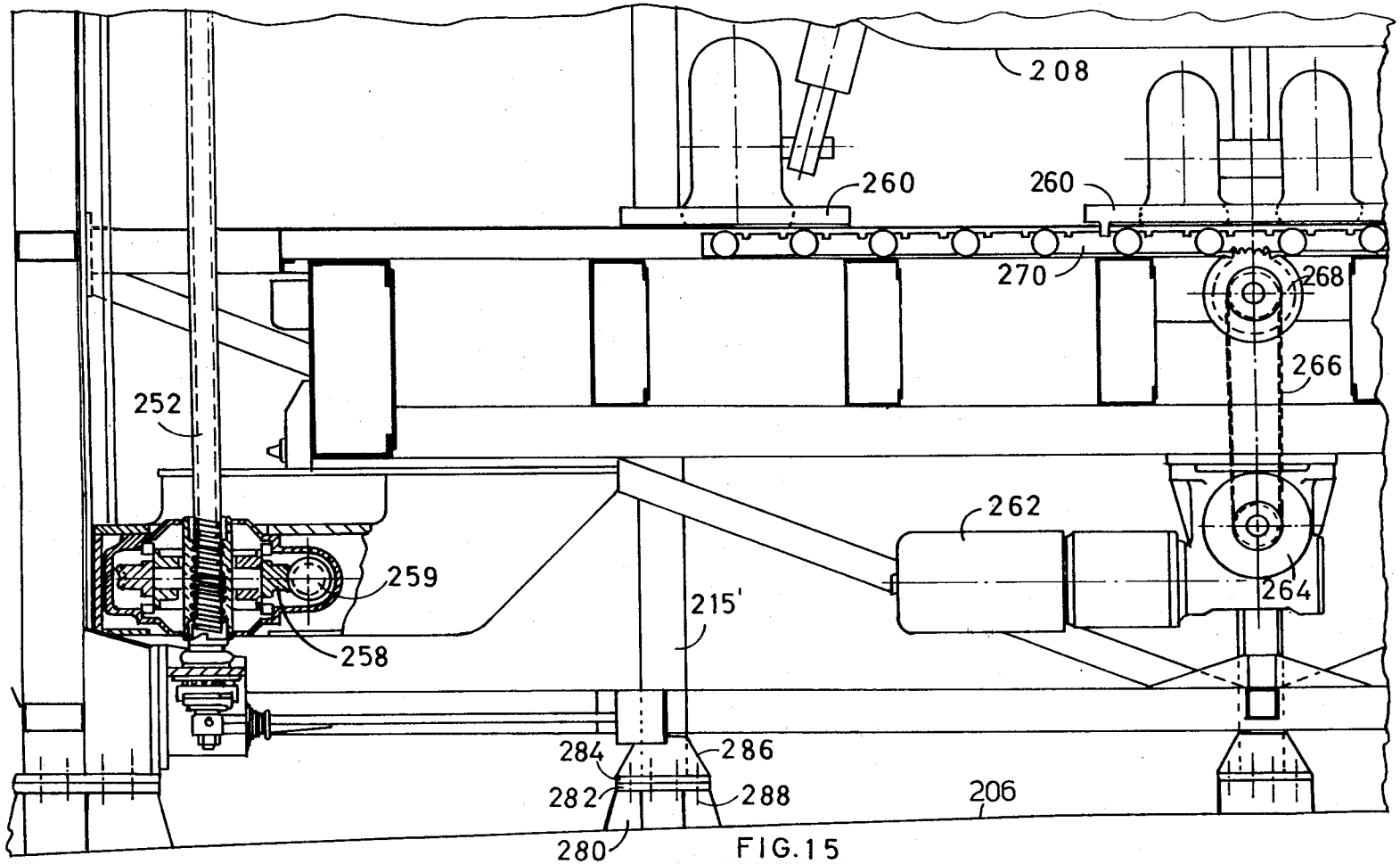

The embodiment of FIGS. 12–15 further includes two carriages for receiving the wheels of the landed helicopter, which carriages are movable in a lateral direction with respect to the lifting platform 230 for centering the helicopter thereon. The carriages generally designated 260 in the drawings and shown particularly in FIG. 15, are driven by a centering drive 262 via a gear 264 coupled by a chain 266 to another gear 268, the latter gear driving a rack 270 coupled to the carriages 260 so as to move them laterally in order to center the helicopter on the lifting platform 230.

When the helicopter has been thus centered on the lifting platform, it may be anchored thereto by attaching an anchoring screen 234 on the lifting platform 230 to an anchoring leg 236 on the helicopter.

The landing pad and hangar structure in the embodiment of FIGS. 12–15 further includes a vertical guiding rail 237 adjacent to the vertical screws 252 at each of the corners of the lifting platform 230, which rails are engageable by guide shoes 238 carried by the lifting platform for guiding its vertical movement.

In addition, this embodiment also includes a signalling platform 240 at one end of the enclosure 210 for accommodating the signalman who signals-in the helicopter during landing. As in the FIGS. 1–6 embodiment, platform 240 is also depressed below the horizontal plane of the slidable panels 216, but is elevated from the ship deck 206, and is accessible from the ship deck by means of a ladder 242. Enclosure 210 further includes access doors 244 for entering or leaving the enclosure 210.

FIG. 15 best illustrates how the enclosure framework 215 is secured to the ship's deck 206. Thus, a plurality of mounting members 280, one for each of the vertical columns 215' of the enclosure framework 215, is fixed to the ship's deck 206, as by welding. Each of the mounting members 280 includes an upper flange 282. These flanges are adapted to be engaged by corresponding flanges 284 carried at the lower ends of base members 286 secured, as by welding, to the lower ends of the vertical columns 215' of the enclosure framework 215. Bolts 288 may then be passed through the mounting member flanges 282 and the base member flanges 284, or other means, such as welding, may be used to firmly secured the enclosure to the deck.

The embodiment illustrated in FIGS. 12–15 is otherwise constructed, and operates in the same manner, as in the earlier-described embodiments.

While the invention has been described with respect to erecting the landing pad and hangar structure on the deck of a ship, it will be appreciated that it could be erected on other structures, such as off-shore drilling rigs, and land-based helicopter pads. In addition, while the deck illustrated in the preferred embodiment is not penetrated by the landing pad and hangar structure, in some applications it may be desirable to penetrate the deck for purposes of providing better stability and a lower silhouette, but even in this case the enclosure should rise above the deck plane, i.e. the sliding top panels of the enclosure should be above the deck plane. This provides one of the advantages of the present invention of enabling the deck immediately around the erected landing pad and hangar structure to be used for other purposes, such as for the placement of weapons systems. In addition, other arrangements than those disclosed can be used for extending or retracting the sliding panels, or raising and lowering the elevator platform. Many other variations, modifications and applications of the invention will be apparent.

What is claimed is:

1. A helicopter landing pad and hangar structure attached to a horizontal deck, particularly to the deck of a ship, in a manner requiring a minimum of space on the deck for both landing and storage, and not requiring substantial modification of the ship structure, characterized in that said landing pad and hangar structure comprises:

an enclosure including a framework attached to, and overlying the face of, said deck, a plurality of side walls attached to said framework and extending above said deck, and a plurality of panels supported by said framework at the top of the side walls above said deck and slidable horizontally to an inner retracted position closing the enclosure or to an outer extended position opening the enclosure and extending laterally past the side walls of the enclosure;

and a lifting platform movable vertically to a lower position within said enclosure or to an upper position spaced substantially above said deck and aligned with the plane of said panels at the top of said enclosure above said deck;

whereby when the lifting platform is in its upper position and at least some of said panels are in their outer extended positions, the lifting platform and the panels together constitute an enlarged-area pad spaced substantially above said deck for the helicopter to land or take-off with a minimum of interference with the ship's normal equipment and functions and with the helicopter operation, and when the lifting platform is in its lower position it permits the helicopter parked thereon to be stored within the enclosure, with the panels at their inner positions closing the enclosure to protect the parked helicopter and to provide a smaller-area pad spaced substantially above said deck for another helicopter to land if needed.

2. The structure according to claim 1, wherein there are two rows each of at least three panels on opposite sides of the longitudinal axis of the enclosure, which panels are slidable towards and away from said longitudinal axis.

3. The structure according to claim 2, wherein each row of panels is of longer length than the length of the lifting platform so that, when the lifting platform is in its elevated position during helicopter landing or take-off, at least two end panels are in their inner positions and the remainder are in their outer positions.

4. The structure according to claim 1, wherein the lower position of the lifting platform is substantially at deck level, said structure further including a signalling platform at one end of the enclosure and depressed below the level of said panels but elevated above the deck, for accommodating a signalman signalling-in the helicopter for a landing.

5. The structure according to claim 1, further including a lifting device coupled to each corner of the lifting platform.

6. The structure according to claim 5, wherein each of said lifting devices comprises a vertically-extending screw member and a nut member at each corner of the lifting platform, one of said members being secured to the enclosure and the other being secured to the corner of the lifting platform, and means for rotating one of said members with respect to the other to effect the lifting and lowering of the platform.

7. The structure according to claim 1, wherein said lifting platform further includes carriage means for receiving the landed helicopter, said carriage means being movable in a lateral direction with respect to the lifting platform for centering the helicopter on the lifting platform.

8. The structure according to claim 1, wherein said panels are slidably mounted on fixed vertical columns between each pair of panels and at the end panels, which columns support rollers receivable within rails carried at the ends of the panels.

9. The structure according to claim 8, wherein said panels are driven to their inner and outer positions by a rack carried by each of said rails driven by a pinion rotated by a drive.

10. The structure according to claim 1, wherein said framework of the enclosure comprises a plurality of vertical columns each secured at its lower end to a base member formed with a flange, and a plurality of mounting members secured to said horizontal surface, said mounting members including flanges which are secured to the flanges of said base members.

* * * * *